US009107781B1

(12) United States Patent
Edgerton

(10) Patent No.: US 9,107,781 B1
(45) Date of Patent: Aug. 18, 2015

(54) HEIGHT ADJUSTABLE APPARATUS WITH OPPOSED LEGS MOVABLY AND PIVOTALLY CONNECTED TO RAILS SUPPORTING A DECK

(75) Inventor: John Edgerton, Omro, WI (US)

(73) Assignee: GF HEALTH PRODUCTS, INC., Atlanta, GA (US)

( * ) Notice: Subject to any disclaimer, the term of this patent is extended or adjusted under 35 U.S.C. 154(b) by 309 days.

(21) Appl. No.: 13/446,803

(22) Filed: Apr. 13, 2012

Related U.S. Application Data

(60) Provisional application No. 61/475,523, filed on Apr. 14, 2011.

(51) Int. Cl.

| | |
|---|---|
| ***A47C 23/02*** | (2006.01) |
| ***A61G 7/002*** | (2006.01) |
| ***A61G 7/012*** | (2006.01) |
| *A61G 7/015* | (2006.01) |

(52) U.S. Cl.
CPC ..... *A61G 7/002* (2013.01); *A61G 7/012* (2013.01); *A61G 7/015* (2013.01)

(58) Field of Classification Search
CPC ..... A61G 7/015; A61G 7/012; A61G 7/018; A61G 7/05; A61G 2007/0509; A61G 2007/0514; A61G 13/06; A61G 7/002; A47C 19/045; A47C 20/041; A47C 17/72; A61B 6/0457
USPC ..... 5/11, 114, 600, 611, 612, 614, 620, 5/625, 627
See application file for complete search history.

(56) References Cited

U.S. PATENT DOCUMENTS

| | | | | |
|---|---|---|---|---|
| 2,675,285 | A | 4/1954 | Terre et al. | |
| 4,718,355 | A | 1/1988 | Houghton | |
| 5,283,919 | A * | 2/1994 | Grant | 5/620 |
| 5,432,966 | A | 7/1995 | Berta et al. | |
| 6,473,922 | B1 | 11/2002 | Sommerfeld et al. | |
| 6,729,667 | B2 | 5/2004 | Henderson et al. | |
| 7,334,277 | B2 | 2/2008 | Johnson | |
| 7,509,697 | B2 * | 3/2009 | Dorenbeck | 5/611 |
| 2009/0094747 | A1 * | 4/2009 | Bly et al. | 5/611 |

* cited by examiner

*Primary Examiner* — Timothy D Collins
*Assistant Examiner* — Richard G Davis
(74) *Attorney, Agent, or Firm* — Brannen Law Office, LLC

(57) ABSTRACT

The present invention relates to an apparatus, such as a bed, having a vertically adjustable deck that is selectably raised and lowered in a substantially vertical manner. Two leg frames are pivotally and movably connected to rails supporting the deck through a slot in the bottom of the rails. Support frames having a fixed longitudinal position relative the bed frame rail are connected to a central pivot point of the leg frames, respectively. The support frames each have a cross member supporting a connection lever defining a path. Actuators are pivotally connected to the bed frame and to a movable pivotal connection point along the path. A control arm is provided to determine the location of the actuator end relative the path of the connection lever. Wheel assemblies can be pivotally connected to the second end of the leg frames.

21 Claims, 7 Drawing Sheets

HEIGHT ADJUSTABLE APPARATUS WITH OPPOSED LEGS MOVABLY AND PIVOTALLY CONNECTED TO RAILS SUPPORTING A DECK

This United States utility patent application claims priority on and the benefit of provisional application 61/475,523 filed Apr. 14, 2011, the entire contents of which are hereby incorporated herein by reference.

BACKGROUND OF THE INVENTION

1. Field of the Invention

The present invention relates to an apparatus, such as a bed, having a vertically adjustable deck that is selectably raised and lowered in a substantially vertical manner under operation of two leg frames pivotally and movably connected to rails supporting the deck.

2. Description of the Related Art

Typically, height and angle adjustable beds are used by medical institutions, such as hospitals, nursing homes and/or long or short term care facilities. The beds usually include a bed frame and an articulating mechanism for lowering the bed frame to a low position and raising the bed frame to a high position so that it may be used as a gurney or at any height in between. As a result, a patient can be transferred by merely sliding the patient from one gurney to another or a chair.

Examples of beds include:

United States published application having publication number 2009/0094747 to Bly, and assigned to Invacare Corporation, is titled Bed Lift Mechanism. This publication illustrates a bed with a leg assembly coupled to a support link assembly by a joint, the joint comprising a slot having at least two paths. A support link assembly defining a length that automatically varies as the support link assembly moves relative to the leg assembly.

United States patent number (hereafter "U.S. Pat. No.") 7,334,277 to Johnson, and assigned to Raye's, Inc. is titled Low Profile Hospital Bed. This patent shows a low profile hospital bed with a mattress support frame and pivotably mounted wheel frames. Lift actuators connecting between the mattress support frame and the wheel frames move the wheel frames between a folded position and an unfolded position. When the wheel frames are in the folded position, the lift actuators are relatively horizontal and thus unable to provide enough vertical force to move the wheel frames. Accordingly, connecting between the actuators and the wheel frames are leverage members which rotate and urge the wheel frames away from mattress support frame during an initial, first stage of movement as the wheel frames partially unfold. After the first stage of movement, the leverage members function as simple mechanical links between the lift actuators and the wheel frames as the lift actuators continue to power the complete unfolding of the wheel frames.

U.S. Pat. No. 6,729,667 to Henderson et al., and assigned to Howard Wright Limited, is titled Stretcher Suspension Linkages. It illustrates a linkage that includes a stretcher receiving frame and a base frame. A pair of arms are pivotally fixed to bottom frame and slidingly connected to frame. A pneumatic suspension unit is located between the arms and a first link pivotally coupled between arms and frame. A cross member of the slide coupling is coupled to a sliding mount of a second link pivotally coupled to an arm pivotally connected to the frame and sliding coupled to the base frame.

U.S. Pat. No. 6,473,922 to Sommerfeld et al., and assigned to Sunrise Medical HHG, Inc., is titled Kinematic Motion of Articulated Bed. This patent shows an articulated bed with a main frame supported by a leg tube. An upper portion of the leg tube is longitudinally and pivotally displaceable relative to the main frame at an upper movable pivot point. A lower portion of a stabilizer is connected to a lower intermediate portion of the leg tube at a lower orbital pivot point. An upper portion of the stabilizer is pivotally connected relative to said main frame at an upper fixed pivot point. A wheel is pivotally attached to a lower portion of the leg tube at a pivot axis. The upper movable pivot point, the lower orbital pivot point, and the pivot axis do not coalign and the distance between the upper fixed pivot point and the upper movable pivot point are maximized when the main frame is in a raised position. The bed of this invention is illustrated schematically in FIG. 10 where it is seen that a pivot axis D, pivot point C and pivot point B do not coalign.

U.S. Pat. No. 5,432,966 to Berta et al. is titled Adjustable Ambulance Cot with Trolley Mechanism. It shows an adjustable roll-in ambulance cot having a cot frame having a leading end, a trailing end, and a pair of opposing side frame members. The cot is supported by leading and trailing pairs of collapsible legs having respective upper ends connected to the cot frame and lower ends including transport wheels thereon for transport of the cot. Mechanisms are also provided for adjusting the height of the cot frame relative to the transport wheels and for latching the cot frame into a plurality of predetermined positions for patient transfer and loading.

U.S. Pat. No. 4,718,355 to Houghton is titled Vertically Adjustable Patient Support Table. It illustrates a patient support platform with a compound leg structure which allows the platform to move to a squatted position giving easy access for a patient or to disposition of a patient thereon and, at the same time, the platform is adjustable to elevated positions so that a standing attendant may administer to the patient. Supporting feet are disposed in a fixed, predetermined pattern and provide pivot points to which the compound leg structures are pivoted. The compound leg structures effect raising and lowering of the platform without changing or disturbing the positions of the feet.

U.S. Pat. No. 2,675,285 to Terry et al. is titled Vertically Adjustable Therapy Treatment Table having Hinged End Sections. It shows a table with folding legs. The legs are connected to and actuated by sleeves slidaby mounted on a threaded rod extended longitudinally through a supporting frame and rotated by a crank.

None of these references show a bed with structures adapted to level the loading output of the actuators by having a connection lever defining a path that is offset from a support frame cross member, wherein the position of the actuator end relative the connection lever path is controlled by a control arm.

None of these references shown a bed with outwardly angled leg frames with their pivots slidable along the bed frame, with a set of supports having a fixed longitudinal position extending from the bed frame to a central pivot point of the leg frames, and actuators are connected to the bed frame and to a movable pivotal connection point offset from the cross member.

None of these references show a bed with movably and pivotably connected legs, wherein the movable and pivotable connection is between the legs and a frame having a slotted bottom member (or tube) to provide symmetry at the connection, maintain structural integrity of the member and eliminate pinch points.

Thus there exists a need for an apparatus such as a bed that solves these and other problems.

SUMMARY OF THE INVENTION

The present invention relates to an apparatus, such as a bed, having a vertically adjustable deck that is selectably raised and lowered in a substantially vertical manner. Two leg frames are pivotally and movably connected to rails supporting the deck through a slot in the bottom of the rails. Support frames having a fixed longitudinal position relative the bed frame rail are connected to a central pivot point of the leg frames, respectively. The support frames each have a cross member supporting a connection lever defining a path. Actuators are pivotally connected to the bed frame and to a movable pivotal connection point along the path. A control arm is provided to determine the location of the actuator end relative the path of the connection lever. Wheel assemblies can be pivotally connected to the second end of the leg frames.

According to one advantage of the present invention, the bed can have structures adapted to level the loading output of the actuators. This is accomplished in one embodiment by having a connection lever defining a path that is offset from a support frame cross brace. A control arm then can control the position of the actuator end relative the connection lever path.

According to another advantage of the present invention, the bed has outwardly angled leg frames with their pivots slidable, rollable or otherwise movable along or within the bed frame and a set of supports having a fixed longitudinal positions extend from the bed frame to a central point of the respective leg frames. This allows the bed to raise and lower in a substantially vertical manner.

According to a still further advantage of the present invention, the rails have bottom surfaces that are slotted along the middle portion, wherein the movably and pivotably connected leg frames are received within slotted structure to eliminate pinch points.

In one preferred embodiment, a translation assembly is provided for moving within the frame member. Advantageously, the translation assembly can be configured in one embodiment to slide in one direction and roll in the opposed direction within the frame member.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
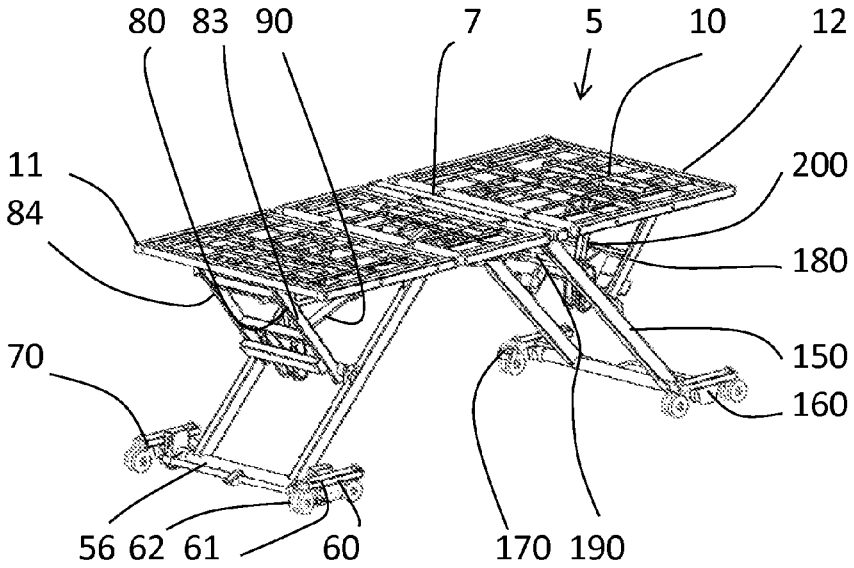
FIG. 1 is a perspective view of a preferred embodiment of the present invention in a high position.
Figure 2:
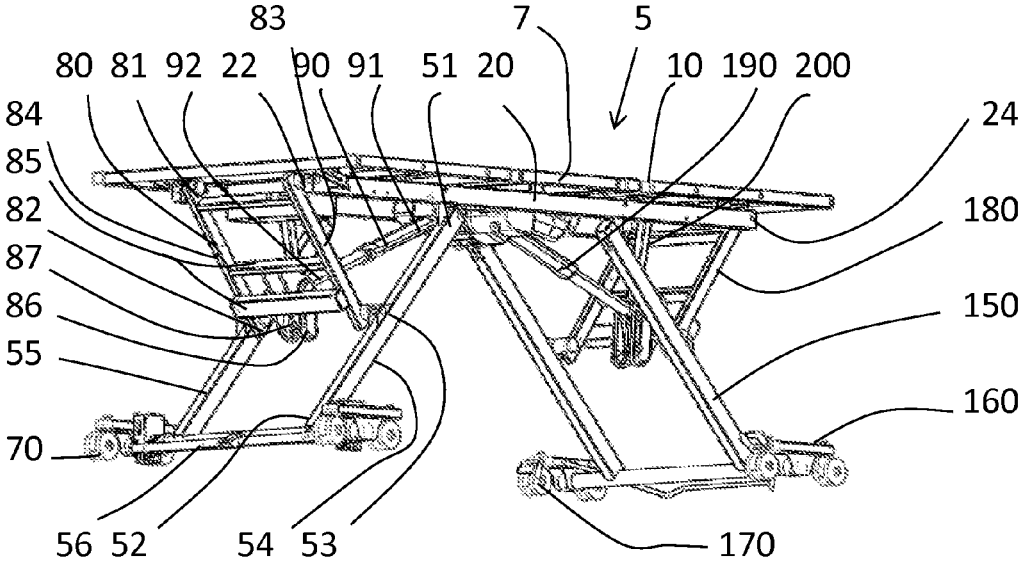
FIG. 2 is an additional perspective view of the preferred embodiment illustrated in FIG. 1.
Figure 3:
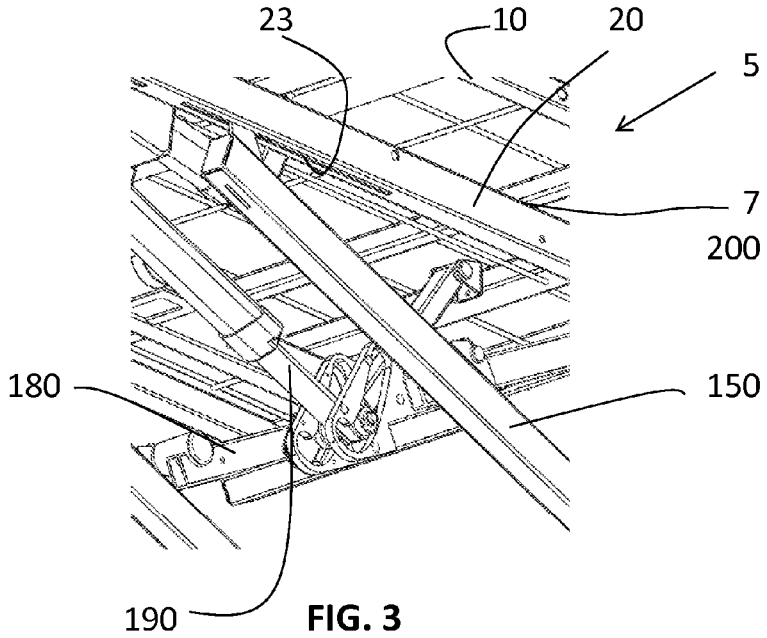
FIG. 3 is a close up perspective view showing an embodiment of the actuator received within the path.
Figure 4:
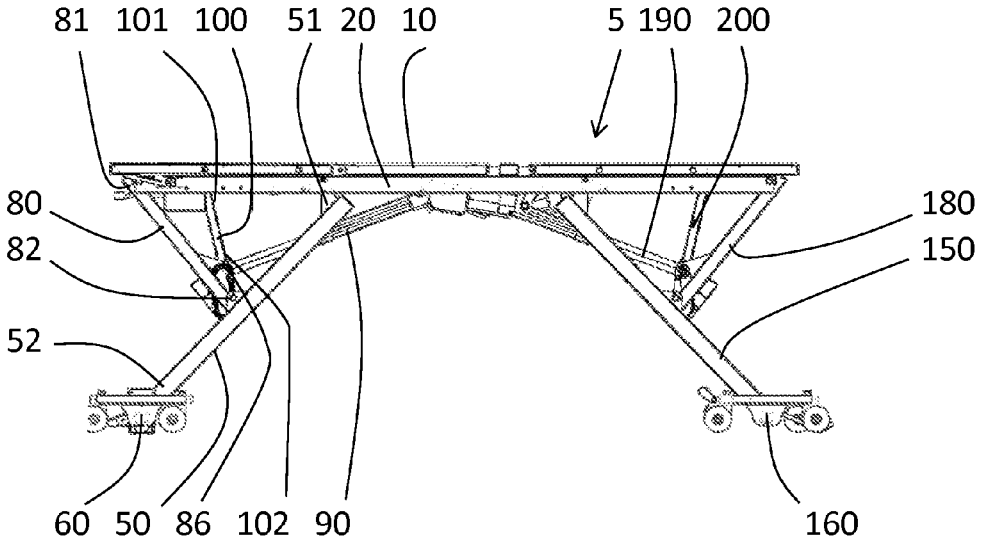
FIG. 4 is a side view of the preferred embodiment of the present invention shown in FIG. 1 in a high position.
Figure 5:
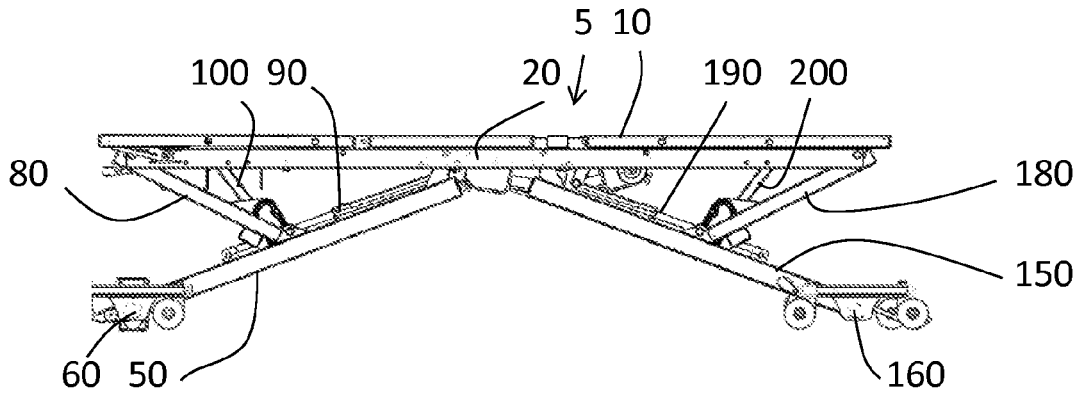
FIG. 5 is a side view of the preferred embodiment of the present invention shown in FIG. 1 in a mid position.
Figure 6:
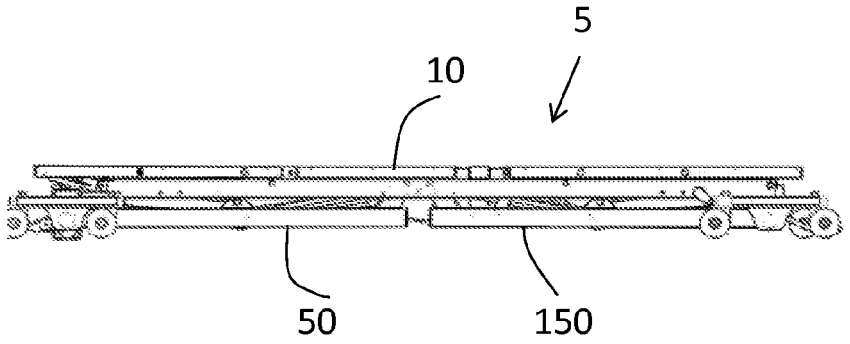
FIG. 6 is a side view of the preferred embodiment of the present invention shown in FIG. 1 in a low position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

A first preferred embodiment of the present invention is illustrated in FIGS. 1-12. Specifically looking at FIGS. 1-6 and 12, it is seen that a bed 5 having a deck 10 supported by rails 20 and 30, leg frame 50, wheel assemblies 60 and 70, support frame 80, actuator 90, control arm 100, leg frame 150, wheel assemblies 160 and 170, support frame 180, actuator 190 and control arm 200 are provided. Each of these components is described in detail below. Specifically looking at FIGS. 7-9, it is seen that the motions of the components are shown schematically.

The deck 10, rail 20 and rail 30 can be collectively called the bed frame 7. The deck 10 of the bed 5 has a first end 11 and a second end 12. A first rail 20 is on the first side of the deck spanning preferably nearly entirely between the ends 11 and 12, and a second rail 30 is provided on the opposite side. Rail 20 has a first slot 21 and a first fixed hole 22, and a second slot 23 and a second fixed hole 24. Slot 21 and hole 22 are on one end of the rail, and slot 23 and hole 24 are on the opposite end of the rail. Slot 21 and slot 23 are preferably located on the underside of rail 20 preferably equidistant between sides of the rail. Yet, it is appreciated that other configurations can be provided without departing from the broad aspects of the present invention. Rail 30 is preferably identical to rail 20.

It is appreciated that while generally rectangular profile rails 20 and 30 are illustrated, that other profile shapes can be used without departing from the broad aspects of the present invention. The slots are preferably located on the bottom of the rails so that the vertical components thereof remain intact to retain maximum structural integrity.

Leg frame 50 has ends 51 and 52 with an intermediate point 53 preferably generally equidistant between the ends. The leg frame 50 has two side members 54 and 55 and a leg cross bar 56 at or near the bottom or distal end 52 spanning between the two side members. The first or connecting end 51 of the leg frame 50 is received within slot 21 of rail 20 and within the first end slot within rail 30. It is appreciated that a rigidly connected ear or lug having a narrow profile is provided at the end of the leg frame 50 so that it can pass through slot 21. The first end 51 can have a retainer such as a translation assembly 75 that maintains the connection between the end 51 and the rails to allow the end 51 to be pivotally and movably retained within the rail.

Wheel assembly 60 has a frame 61 and wheels 62. The wheel frame 61 is preferably pivotally connected to end 51 of the leg frame 50 on side 54. Wheel assembly 70 has a frame and wheels. The wheel frame is preferably pivotally connected to end 51 of the leg frame 50 on side 55. The wheel assemblies 60 and 70 are pivotally connected to the leg frame along a wheel assembly pivot axis.

Figure 10:
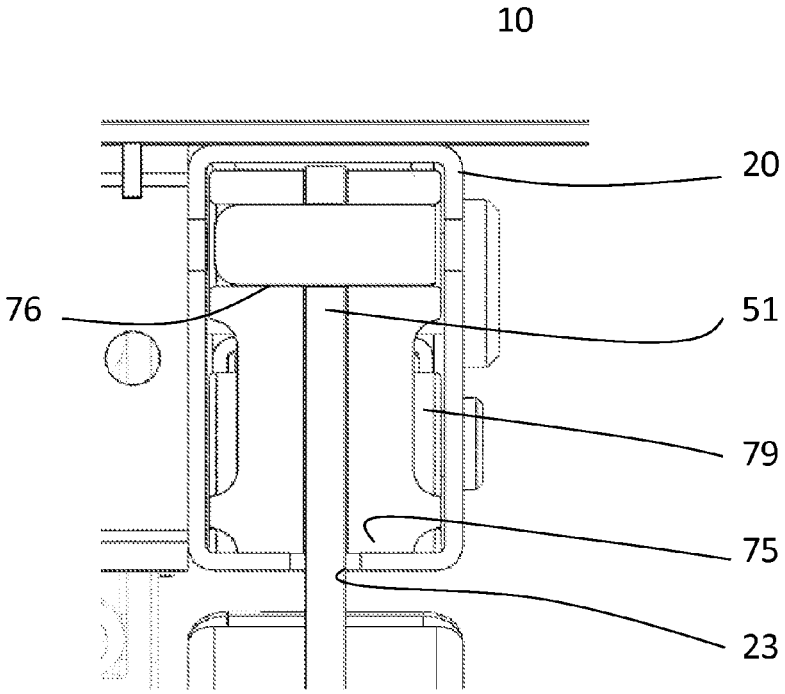
FIG. 10 is a cross-sectional view taken through a pivotal connection of the translation assembly where the leg frame is pivotally and movably connected to a rail.
Figure 11:
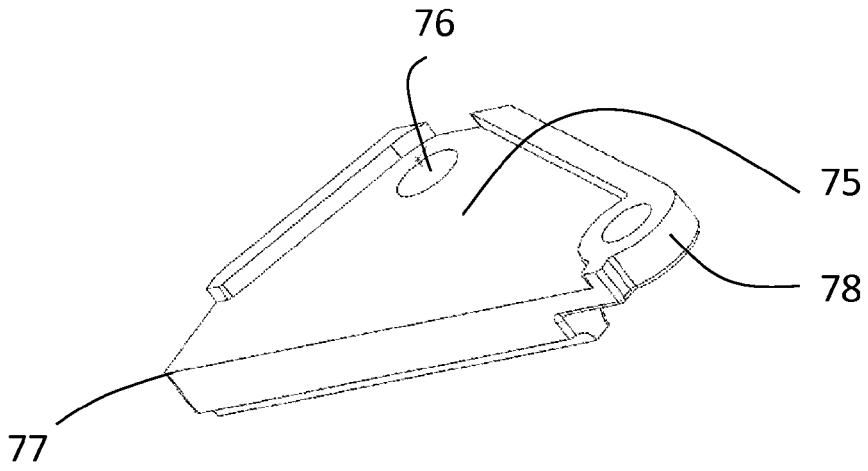
FIG. 11 is a perspective isolation view of a preferred translation assembly.
Figure 12:
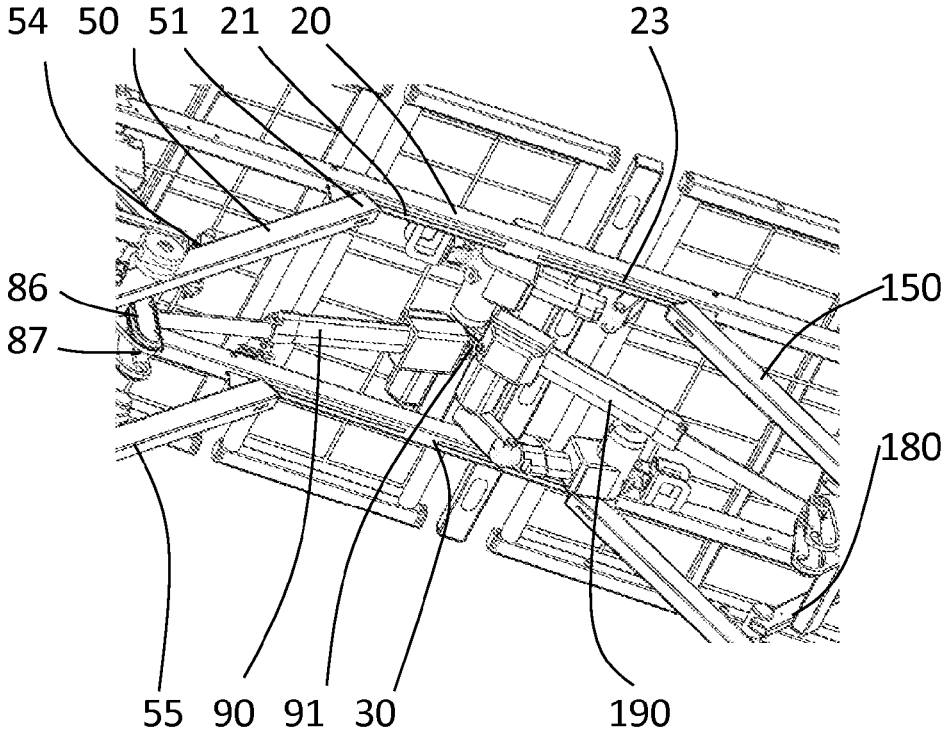
FIG. 12 is a lower perspective view of a preferred embodiment of the present invention.

As best seen in FIGS. 10 and 11, the translation assemblies 75 have a pivot axis 76 and opposed ends 77 and 78. The first end 77 can be adapted to slide and the second end can be mated with a roller or wheel 79 to provide rolling friction instead of sliding friction. Each translation assembly is preferably substantially or completely housed within the respective rail. Sliding friction can be the prevailing friction force when the translation assembly is moving in a first direction, and rolling friction can be the prevailing friction when the translation assembly is moving in the opposite or second direction. In is understood that the illustrated embodiment of the translation assembly is exemplary in nature, and the translation mechanism could have other structures, even a single block without departing from the broad aspects of the present invention.

A support frame 80 is further provided, and has a first end 81 and a second end 82. Support frame 80 has two sides 83 and 84, and one or more cross members 85. A connection lever 86 is connected to a cross member 85. It is understood that the connection lever 86 could be attached to more than one cross member without departing from the broad aspects of the present invention. The connection lever defines a path 87 (or slot, channel or other structure). The path can accommodate a roller or other type of device to facilitate movement along the path. Path 87 is preferably arcuate, but may be straight without departing from the broad aspects of the present invention. End 81 of support frame 80 is preferably pivotally connected to rail 20 at hole 22 and also to rail 30. End 82 is preferably pivotally connected to intermediate point 53 of the leg frame 50 about the support frame and leg frame pivot axis. The length of the support frame 80 is equal to ½ of the length of the leg. The support frame preferably dissects the length of the leg frame 50 to two equal lengths on each side of the intermediate point 53. Any given fixed point on path 87 of the connection lever 86 orbits about the support frame and pivot frame pivot axis. It is understood that the geometric longitudinal shape of path 87 can vary as desired to impart any desired path relative the support frame and pivot frame pivot axis.

Actuator 90 has opposed ends 91 and 92. Actuator 90 is preferably a linear actuator. Actuator end 91 is preferably pivotally connected to deck 10, and end 92 is preferably movably and pivotally connected to the connection lever 86 at a point along path 87.

Control arm 100 has ends 101 and 102. End 101 of control arm is pivotally connected to the deck 10, and end 102 is connected to the second end 92 of the actuator 90 to control the location of the actuator end 92 within path 87. In the illustrated embodiment, the angle between control arm 100 and the actuator 90 is acute when the bed 5 is in a high position, and obtuse when the bed 5 is in the low position. The control arm 100 is in tension when the angle is acute, and is in compression when the angle is obtuse. The control arm is neither in compression nor tension when the angle is a right angle. It is understood that the angle between the control arm and actuator may remain obtuse throughout the entire stroke of the actuator without departing from the broad aspects of the present invention.

Figure 7:
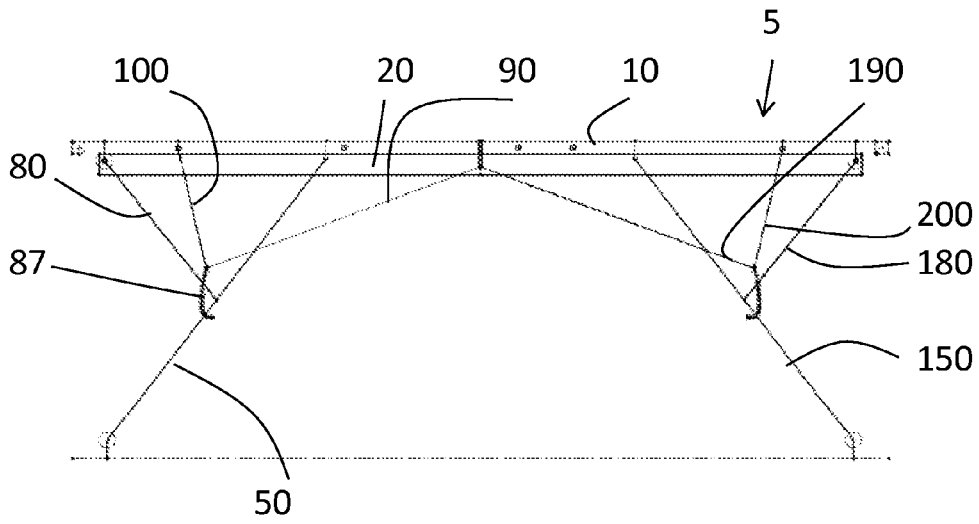
FIG. 7 is schematic view of the preferred embodiment of the present invention shown in FIG. 1 in a high position.
Figure 8:
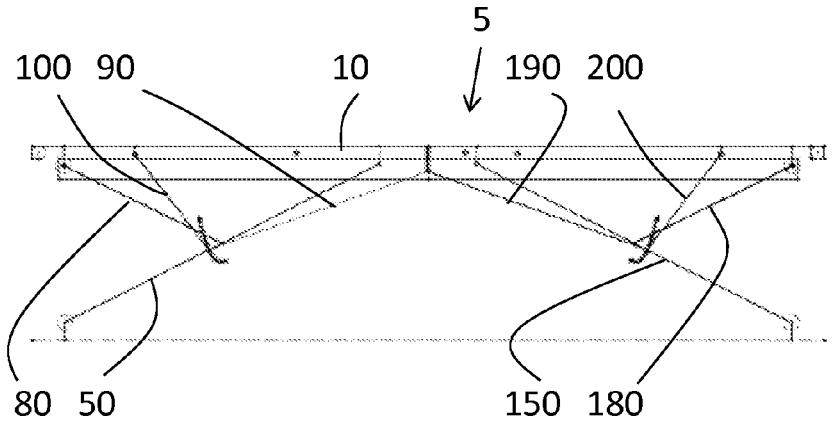
FIG. 8 is schematic view of the preferred embodiment of the present invention shown in FIG. 1 in a mid position.
Figure 9:
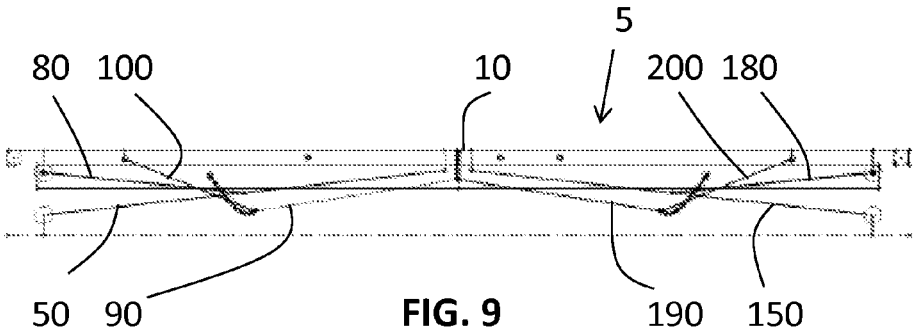
FIG. 9 is schematic view of the preferred embodiment of the present invention shown in FIG. 1 in a low position.

The wheel frame pivot axis is preferably aligned with the leg frame and rail pivot axis and the leg frame and support frame pivot axis along a straight line, as seen in the schematic drawings of FIGS. 7-9.

It is preferred that the pivot axis between the leg frame 50 and the rail 20, and the pivot axis between the support frame 80 and the rail are generally horizontal. Yet, it is understood that the leg frame pivot axis could be marginally higher than the support frame pivot axis under zero-load conditions so that they may become horizontally aligned under the frame deflections that will occur under maximum anticipated loading conditions.

Leg frame 150 is similar to frame 50 and has ends with an intermediate point preferably equidistant between the ends. The leg frame 150 has two side members and a leg cross bar at or near the bottom or distal end spanning between the two side members.

The first or connecting ends of the leg frame 150 sides are received within slot 23 of rail 20 and within the first end slot within rail 30, respectively. It is appreciated that a rigidly connected ear or lug having a narrow profile is provided at the end of the leg frame 150 so that it can pass through slot 23. The first end can have a translation assembly 75 that maintains the connection between the leg frame and the rails in a symmetric relationship, and also allows the end of the leg frame to be pivotally and movably retained by the rails. It is appreciated that while rails are shown, that other connectors may be utilized without departing from the broad aspects of the present invention.

Wheel assembly 160 has a frame and wheels. The wheel frame is preferably pivotally connected to the end of the leg frame on the first side of the frame. Wheel assembly 170 has a frame and wheels. The wheel frame is preferably pivotally connected to end of the leg frame 150 on side the leg frame second side. The wheel assemblies 160 and 170 are pivotally connected to the leg frame along a wheel assembly pivot axis.

A support frame 180 is further provided, and has a first end and a second end. Support frame 180 has two sides and a cross member. A connection lever is connected to the cross member. The connection lever defines a path (or slot, channel or other structure). The path is preferably arcuate, but may be straight without departing from the broad aspects of the present invention. The ends of support frame 180 are preferably pivotally (but longitudinally stationarily) connected to rail 20 at hole 24 and also to rail 30. The opposite end of the frame 180 is preferably pivotally connected to intermediate point of the leg frame 150 about the support frame and leg frame pivot axis. The length of the support frame 180 is equal to ½ of the length of the leg. The support frame preferably dissects the length of the leg frame 150 to two equal lengths. Any given fixed point on the path of the connection lever orbits about the support frame and pivot frame pivot axis. It is understood that the geometric longitudinal shape of path can vary as desired to impart any desired path relative the support frame and pivot frame pivot axis.

Actuator 190 is provided and has opposed ends. Actuator 190 is preferably a linear actuator. The actuator first end is preferably pivotally connected to deck 10, and the second is preferably movably and pivotally connected to the connection lever at a point along its path.

Control arm 200 is further provided. The first end of control arm is pivotally connected to the deck 10, and the second end is connected to the second end of the actuator 190 to control the location of the actuator end within the path of the connection lever. The angle between control arm 200 and the actuator 190 is acute when the bed 5 is in a high position, and obtuse when the bed 5 is in the low position. The control arm 200 is in tension when the angle is acute, and is in compression when the angle is obtuse. The control arm is neither in compression nor tension when the angle is a right angle. It is appreciated that leg frames 50 and 150 work in equal and opposite manners to achieve a substantially vertical rise in the bed 5. However, it is further appreciated that in an alternative embodiment of the present invention (not shown), that a drag link or similar structure could be provided so that one of the two actuators could be eliminated.

Figure 13:
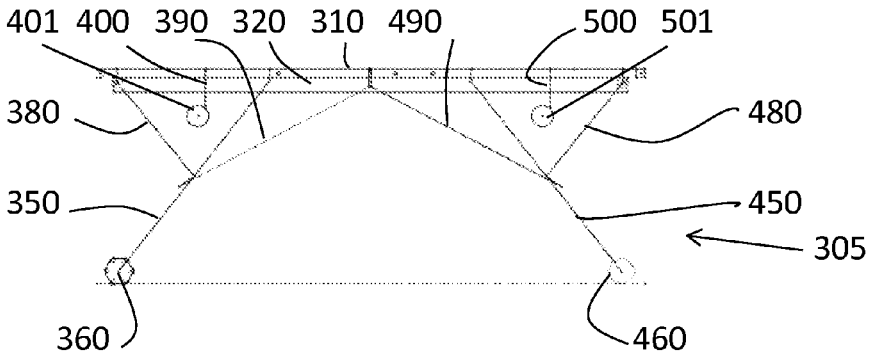
FIG. 13 is a schematic view of an alternative preferred embodiment showing a roll in low only configuration in the high position.
Figure 14:
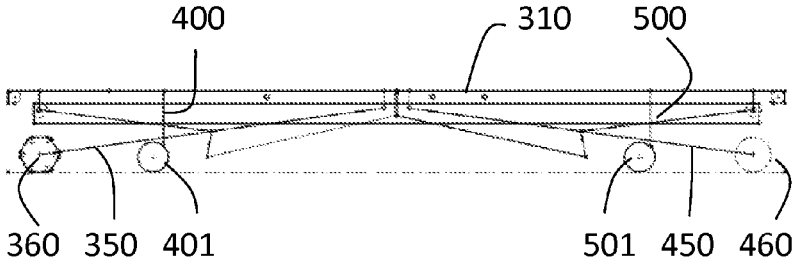
FIG. 14 is a schematic view of an alternative preferred embodiment shown in FIG. 13 in the low position.
Figure 15:
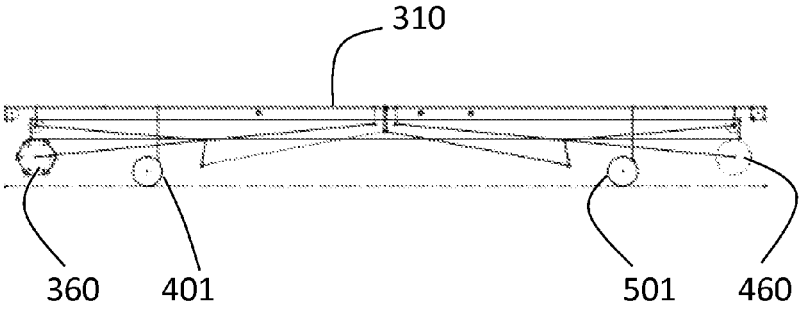
FIG. 15 is a schematic view of an alternative preferred embodiment shown in FIG. 13 in the roll position.

Turning now to FIGS. 13-15, an alternative embodiment is shown schematically. The bed 305 is a roll in low only design, having a deck 310 with a rail 320, a leg frame 350, a support frame 180 and an actuator 390. A low only wheel assembly 400 with a wheel 401 is also shown. On the opposite side of the bed 305 are a second leg frame 450, wheel assembly 460, support frame 480 and actuator 490. A second low only wheel assembly 500 with wheel 501 is further provided. The wheels 401 and 501 are only operational when the bed 305 is all the way in the lowest position, when wheel assemblies 360 and 460 are rotated off of the ground.

Thus it is apparent that there has been provided, in accordance with the invention, a height adjustable apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bed comprising:

a bed frame having:

a deck;

a first rail; and a second rail;

a first leg frame being pivotally and movably connected to said first rail and said second rail;

a second leg frame being pivotally and movably connected to said first rail and said second rail;

a first support frame being connected to said bed frame and to said first leg frame, said first support frame having a first support frame lever defining a first support frame lever path;

a second support frame being connected to said bed frame and to said second leg frame, said second support frame having a second support frame lever defining a second support frame lever path;

a first actuator connected to said bed frame and movably and pivotally connected to said first support frame lever; and a second actuator connected to said bed frame and movably and pivotally connected to said second support frame lever, wherein actuation of said first actuator and said second actuator cause said bed frame to selectably rise and lower.

2. The bed of claim 1 wherein said first support frame has a first support frame cross member and said first support frame lever is connected to said first support frame cross member wherein said first support frame lever path is offset from said first support member cross member.

3. The bed of claim 1 wherein a location of said first actuator relative to said first support frame lever is determined by a control arm, wherein said control arm is connected to said bed frame and to said first actuator.

4. The bed of claim 1 wherein said first rail comprises a first rail top and a first rail bottom, said first rail having a first rail slot through said first rail bottom.

5. The bed of claim 4 further comprising a translation assembly housed within said first rail wherein said first leg frame is pivotally connected to said translation assembly to move within said first rail.

6. The bed of claim 5 wherein said translation assembly comprises a first end with a wheel and a second end without a wheel, whereby friction between said translation assembly and said first rail is reduced in one direction.

7. The bed of claim 4 wherein said first rail slot is centrally aligned on said first rail bottom.

8. The bed of claim 1 wherein:

said first leg frame has a midpoint; and said first support frame is pivotally connected to said bed frame and to said first leg frame at said midpoint.

9. A bed comprising:

a bed frame having:

a deck;

a first rail; and a second rail;

a first leg frame having a first leg frame midpoint that is generally equidistant between a first leg frame first end and a first leg frame second end, said first leg frame being pivotally and movably connected to said first rail and said second rail;

a second leg frame having a second leg frame midpoint that is generally equidistant between a second leg frame first end and a second leg frame second end, said second leg frame being pivotally and movably connected to said first rail and said second rail;

a first support frame having a first support frame cross member and being pivotally connected to said bed frame at a first fixed location and to said first leg frame at said first leg frame midpoint which is at a second fixed location, said first support frame spanning a fixed length between said first fixed location and said second fixed location;

a second support frame having a second support frame cross member and being pivotally connected to said bed frame and to said second leg frame at said second leg frame midpoint;

a first actuator connected to said bed frame and pivotally connected to said first support frame at a point offset from said first support frame cross member; and a second actuator connected to said bed frame and pivotally connected to said second support frame at a point offset from said second support frame cross member, wherein actuation of said first actuator and said second actuator cause said bed frame to selectably rise and lower.

10. The bed of claim 9 wherein:

said first support frame further comprises a first support frame lever defining a first support frame path;

said second support frame further comprises a second support frame lever defining a second support frame path, wherein:

said first actuator is connected to a point along said first support frame path; and said second actuator is connected to a point along said second support frame path.

11. The bed of claim 10 wherein:

said first actuator is selectably connected to a movable point along said first support frame path; and said second actuator is selectably connected to a movable point along said second support frame path.

12. The bed of claim 11 further comprising a control arm to control the location of said first actuator relative said first support frame path.

13. The bed of claim 9 wherein said first leg frame midpoint is equidistant between said first leg frame first end and said first leg frame second end.

14. The bed of claim 9 wherein said first rail comprises a first rail top and a first rail bottom, said first rail having a first rail slot through said first rail bottom.

15. The bed of claim 14 further comprising a translation assembly housed within said first rail wherein said first leg frame is pivotally connected to said translation assembly to move within said first rail.

16. The bed of claim 15 wherein said translation assembly comprises a first end with a wheel and a second end without a wheel, whereby friction between said translation assembly and said first rail is reduced in one direction.

17. A bed comprising:

a bed frame having:

a deck;

a first rail having a first rail bottom with a first rail first slot and a first rail second slot through said first rail bottom, said first rail bottom having a first rail bottom width and said first rail first slot having a first rail first slot width that is smaller than said first rail bottom width; and a second rail having a second rail bottom with a second rail first slot and a second rail second slot through said second rail bottom, said second rail bottom having a second rail bottom width and said second rail first slot having a second rail first slot width that is smaller than said second rail bottom width;

a first leg frame being pivotally and movably connected to said first rail and said second rail through said first rail first slot and said second rail first slot;

a second leg frame being pivotally and movably connected to said first rail and said second rail through said first rail second slot and said second rail second slot;

a first support frame being pivotally connected to said bed frame and to said first leg frame;

a second support frame being pivotally connected to said bed frame and to said second leg frame;

a first actuator connected to said bed frame and pivotally connected to said first support frame; and a second actuator connected to said bed frame and pivotally connected to said second support frame, wherein:

actuation of said first actuator and said second actuator cause said bed frame to selectably rise and lower.

18. The bed of claim 17 further comprising a translation assembly housed within said first rail wherein said first leg frame is pivotally connected to said translation assembly to move within said first rail.

19. The bed of claim 18 wherein said translation assembly comprises a first end with wheel that engages said first rail bottom wherein a rolling friction is a prevailing friction when said translation assembly is moved in a first direction and a second end without a wheel wherein a sliding friction is said prevailing friction when said translation assembly is moved in a second direction.

20. The bed of claim 17 wherein said first rail first slot and said first rail second slot are centrally aligned on said first rail bottom.

21. A bed comprising:

a bed frame having:

a deck;

a first rail; and a second rail;

a first leg frame having a first leg frame midpoint that is generally equidistant between a first leg frame first end and a first leg frame second end, said first leg frame being pivotally and movably connected to said first rail and said second rail;

a second leg frame having a second leg frame midpoint that is generally equidistant between a second leg frame first end and a second leg frame second end, said second leg frame being pivotally and movably connected to said first rail and said second rail;

a first support frame having a first support frame cross member and being pivotally connected to said bed frame at a fixed location and to said first leg frame at said first leg frame midpoint;

a second support frame having a second support frame cross member and being pivotally connected to said bed frame and to said second leg frame at said second leg frame midpoint;

a first actuator connected to said bed frame and pivotally connected to said first support frame at a point offset from said first support frame cross member; and a second actuator connected to said bed frame and pivotally connected to said second support frame at a point offset from said second support frame cross member, wherein actuation of said first actuator and said second actuator cause said bed frame to selectably rise and lower, wherein:

said first support frame further comprises a first support frame lever defining a first support frame path;

said second support frame further comprises a second support frame lever defining a second support frame path, said first actuator is selectably connected to a movable point along said first support frame path; and said second actuator is selectably connected to a movable point along said second support frame path.

* * * * *